US012121825B1

(12) United States Patent
Zhang

(10) Patent No.: US 12,121,825 B1
(45) Date of Patent: Oct. 22, 2024

(54) PRESSING TOY

(71) Applicant: Gengcai Zhang, Guangdong (CN)

(72) Inventor: Gengcai Zhang, Guangdong (CN)

( * ) Notice: Subject to any disclaimer, the term of this patent is extended or adjusted under 35 U.S.C. 154(b) by 0 days.

(21) Appl. No.: 18/623,097

(22) Filed: Apr. 1, 2024

(51) Int. Cl.
*A63H 27/10* (2006.01)

(52) U.S. Cl.
CPC ..... *A63H 27/10* (2013.01); *A63H 2027/1033* (2013.01); *A63H 2027/1041* (2013.01)

(58) Field of Classification Search
CPC ..... A63H 27/10; A63H 2027/1033; A63H 2027/1041; A63H 29/24; A63H 33/30
USPC ... 446/1, 220, 440, 451, 459, 460, 461, 486, 446/491; 273/440, 451, 459, 460, 461
See application file for complete search history.

(56) References Cited

U.S. PATENT DOCUMENTS 3,336,030 A * 8/1967 Martell ..... A63G 31/007 273/349
3,608,903 A * 9/1971 Cooper ..... A63F 9/0079 273/287
3,795,400 A * 3/1974 Glass ..... A63F 9/0079 273/458
4,169,593 A * 10/1979 Wood ..... A63F 9/0079 273/458
4,201,387 A * 5/1980 Revermann ..... A63F 3/00006 273/243
4,826,161 A * 5/1989 Rookmaaker ..... A63F 9/0093 273/458
5,324,045 A * 6/1994 Trawick ..... A63F 9/0079 251/303
7,134,665 B2 * 11/2006 Holsten ..... A63F 9/00 273/458
7,487,972 B2 * 2/2009 Halliburton ..... A63F 7/027 273/458
8,257,134 B2 * 9/2012 Zuloff ..... A63F 5/04 124/37
8,647,203 B2 * 2/2014 Albrecht ..... G06Q 30/0207 200/16 R
8,714,555 B1 * 5/2014 Kelsey ..... A63F 9/0079 273/458
8,794,627 B2 * 8/2014 Watanabe ..... G07F 17/38 273/121 B
11,759,699 B2 * 9/2023 Gottesman ..... A63F 9/30
11,980,829 B2 * 5/2024 Zhan ..... A63H 33/22
2006/0232014 A1 * 10/2006 Holsten ..... A63H 37/00 273/458

(Continued)

*Primary Examiner* — Joseph B Baldori

(57) ABSTRACT

A pressing toy is disclosed, including a casing with a pressing panel on a front side thereon. The pressing panel on the front side of the casing is provided with an array of pressing grooves, and the pressing grooves are equipped with pressing components that cooperate with the pressing grooves. Hand grip grooves are opened on both sides of a casing surface. A penalty mechanism is added, whereupon failure to clear a level, the air pump quantitatively inflates the balloon, and when the number of failures reaches a certain amount, the balloon explodes, increasing the toy's tension and pressure, enhancing the excitement of the gaming experience, emphasizing the importance of clearance, allowing multiple players to experience together, increasing the fun, preventing players from getting bored with the toy in a short period, and facilitating the quick installation of multiple balloons by players.

3 Claims, 3 Drawing Sheets

(56) References Cited

U.S. PATENT DOCUMENTS

| | | | | |
|---|---|---|---|---|
| 2010/0267309 | A1* | 10/2010 | Hyland | A63F 9/0079<br>446/188 |
| 2022/0007863 | A1* | 1/2022 | Thompson | A63H 3/003 |
| 2022/0212095 | A1* | 7/2022 | Caiola, III | A63F 9/0079 |
| 2024/0130546 | A1* | 4/2024 | Johnston | H05B 1/0272 |

* cited by examiner

PRESSING TOY

TECHNICAL FIELD

The present disclosure relates to the technical field of toy technologies, particularly to a new type of pressing toy.

BACKGROUND

Pressing toys require users to judge whether they need to press or tap based on the brightness or protrusion of the target object on the toy. After pressing or tapping, the target object will retract into the toy, providing good exercise for the user's manual dexterity and observation skills.

According to patent number CN219185823U, a whack-a-mole toy is related to the field of toy technology. It includes a casing, a pressing component set on the casing, and a reset component slidably set on the casing. The pressing component includes several reset buttons exposed outside the casing. The reset component includes an elastic component set inside the casing, a reset seat slidably set on the casing, and a top support component set on the reset seat, with the reset seat exposed outside the casing. The reset button is pressed inwardly towards the casing, causing the reset seat to slide, and the top support component supports the sliding or deformation reset of the reset button, while the elastic component provides a force to reset the reset seat. This design eliminates the need for users to disassemble the casing or reset each reset button individually, effectively improving the convenience of resetting the reset buttons and making it possible for young users to complete independently, enhancing the age-applicability of the product.

Existing pressing toys only provide auditory cues to users before clearance is achieved, and do not create tension or excitement for users upon failure, leading to a careless attitude among users and accelerating their boredom with the toy.

SUMMARY

The present disclosure aims to address technical issues in existing technology where users cannot experience tension and excitement during play, leading to quick boredom with the toy. It introduces a new type of pressing toy.

To achieve these objectives, the present disclosure adopts following technical solutions. In some embodiments of the present disclosure, a new type of pressing toy is provided, including a casing with a pressing panel on a front side thereon. An array of pressing grooves is arranged on a front side of the pressing panel, housing pressing components that cooperate with them. Hand grip grooves are opened on both sides of a casing surface, and a control button is provided on a top surface of the pressing panel.

Preferably, the casing surface is equipped with a charging interface, specifically a USB interface. A turntable is installed on the top surface of the casing, with balloons arranged in a circular pattern on its top surface. An air pump is housed inside the casing, with its connection end threadedly connected to an inflation tube. A bottom circumference of the turntable is equipped with an inflation joint corresponding to an installation port penetrating its top surface, and a connecting rod is screw-connected to its bottom.

Preferably, an inlet end of each balloon is embedded in the installation port on the top surface of the turntable, and the inlet end of the balloon is sleeved on a surface of the inflation joint.

Preferably, a connecting head is housed inside the casing, with the connecting rod and connecting head in the same horizontal plane within an interface on the top surface of the casing.

Preferably, a driving motor is housed inside the casing, with its rotating end connected to the connecting head, and an installation joint provided at the bottom of the connecting rod.

Preferably, the inflation tube is embedded in a through hole on the top surface of the casing, with a sealing head provided on the surface of its inlet end in close contact with the bottom surface of the inflation joint.

Preferably, an elevating member is housed inside the casing, screw-connected to the bottom surface of the air pump.

The pressing toy of the present disclosure has at least following beneficial effects.

In the present disclosure, a penalty mechanism is introduced whereby the air pump inflates the balloons quantitatively after a failed clearance. Upon reaching a specific number of failures, the balloons explode, adding tension and pressure to the toy, enhancing the game experience's excitement, prompting players to focus on clearing levels. Multi-player engagement enhances enjoyment, prevents rapid player boredom, and facilitates quick installation of multiple balloons. Following a balloon explosion, positions can be alternated and rotated, with a straightforward structure and convenient operation, enabling simultaneous installation of multiple balloons without the need for frequent replacements.

Additionally, in the present disclosure, one end of the inflation tube is securely sealed within the inflation joint using a sealing head to prevent air leakage from the balloons. The inflation port can be lowered when necessary to rotate and alternate balloon positions, maintaining a simple structure and convenient operation.

BRIEF DESCRIPTION OF THE DRA WINGS

Figure 1:
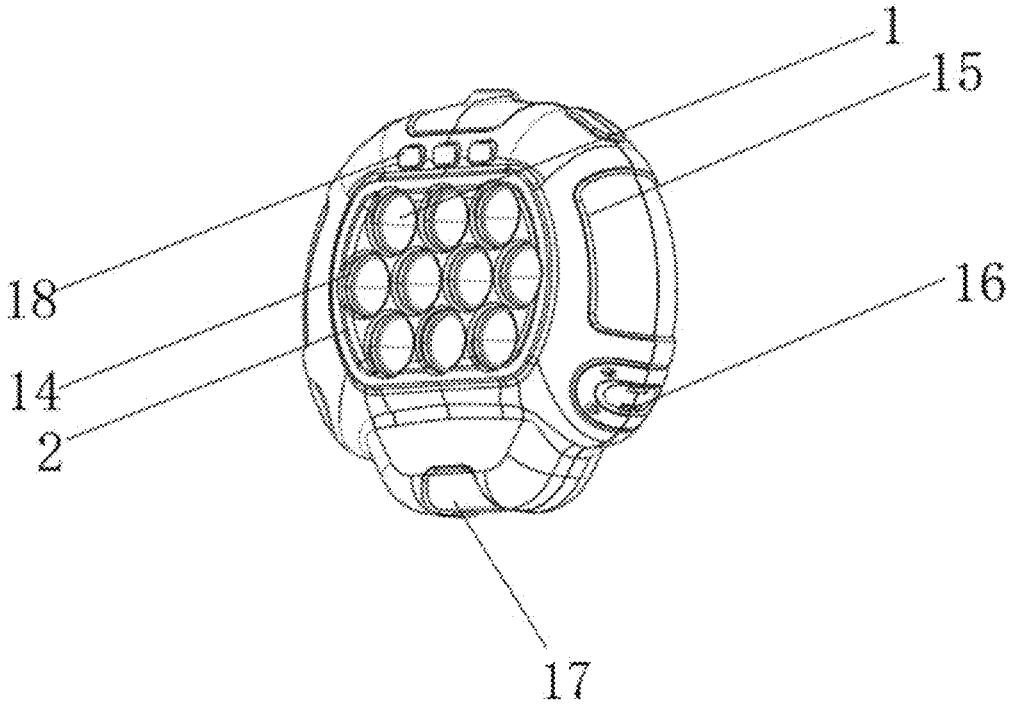
FIG. 1 shows an overall schematic diagram of a casing in accordance with some embodiments of the present disclosure.

In the drawings, reference signs are as follows. 1. Casing, 2. Pressing panel, 3. Connector, 4. Drive motor, 5. Turntable, 6. Connecting rod, 7. Installation joint, 8. Balloon, 9. Inflation joint, 10. Air pump, 11. Inflation tube, 12. Sealing head, 13. Elevating member, 14. Pressing groove, 15. Pressing component, 16. Charging interface, 17. Hand grip groove, 18. Control button, 19. Installation port.

DETAILED DESCRIPTION OF THE EMBODIMENTS

For the purpose of facilitating a clear understanding of the technical means, creative features, achievement of objectives, and effects achieved by the present disclosure, the following detailed description is provided in conjunction with specific embodiments and accompanying drawings. It should be noted that the following embodiments are merely preferred embodiments of the present disclosure and do not exhaust all possibilities. Based on the embodiments' technical means, other embodiments obtained by those skilled in the art without inventive labor also fall within the scope of protection of the present disclosure.

The specific embodiments of the present disclosure are described below in conjunction with the accompanying drawings.

SPECIFIC EMBODIMENTS

Specific Implementation Example 1

Figure 2:
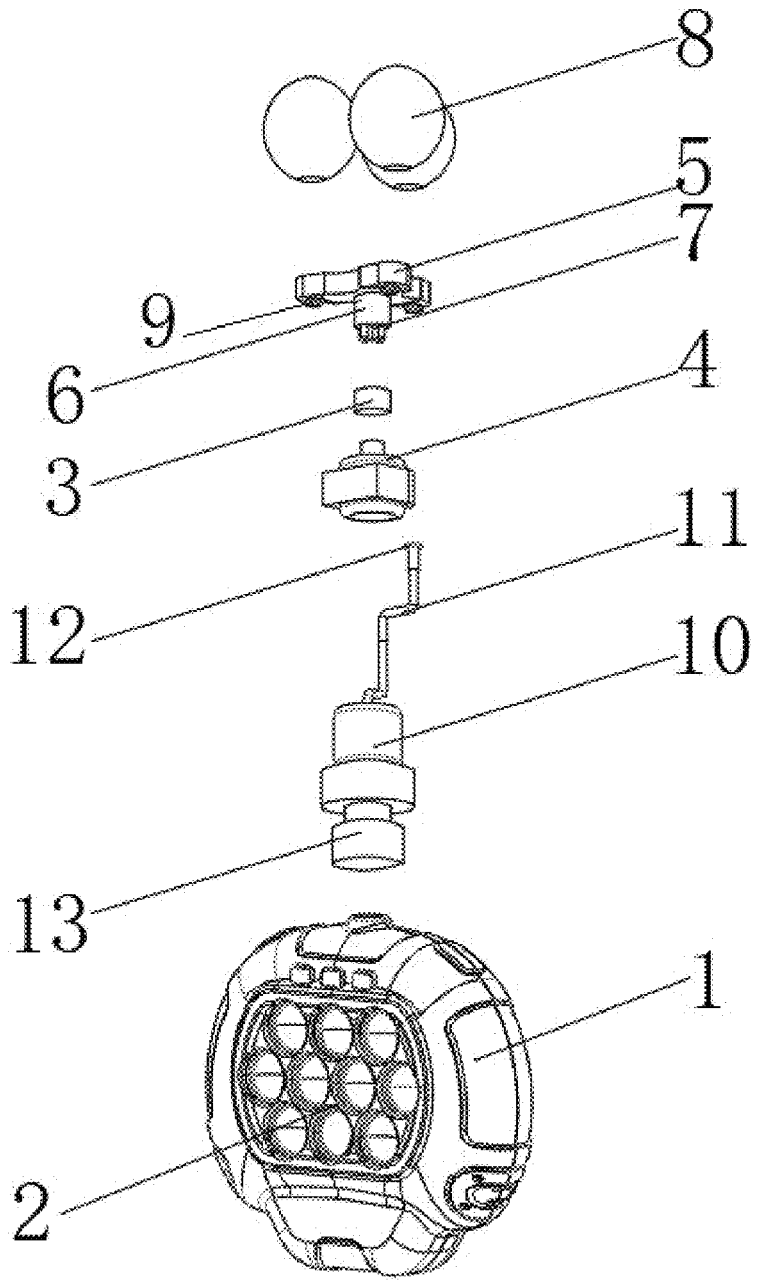
FIG. 2 shows an exploded view of a pressing toy in accordance with some embodiments of the present disclosure.
Figure 3:
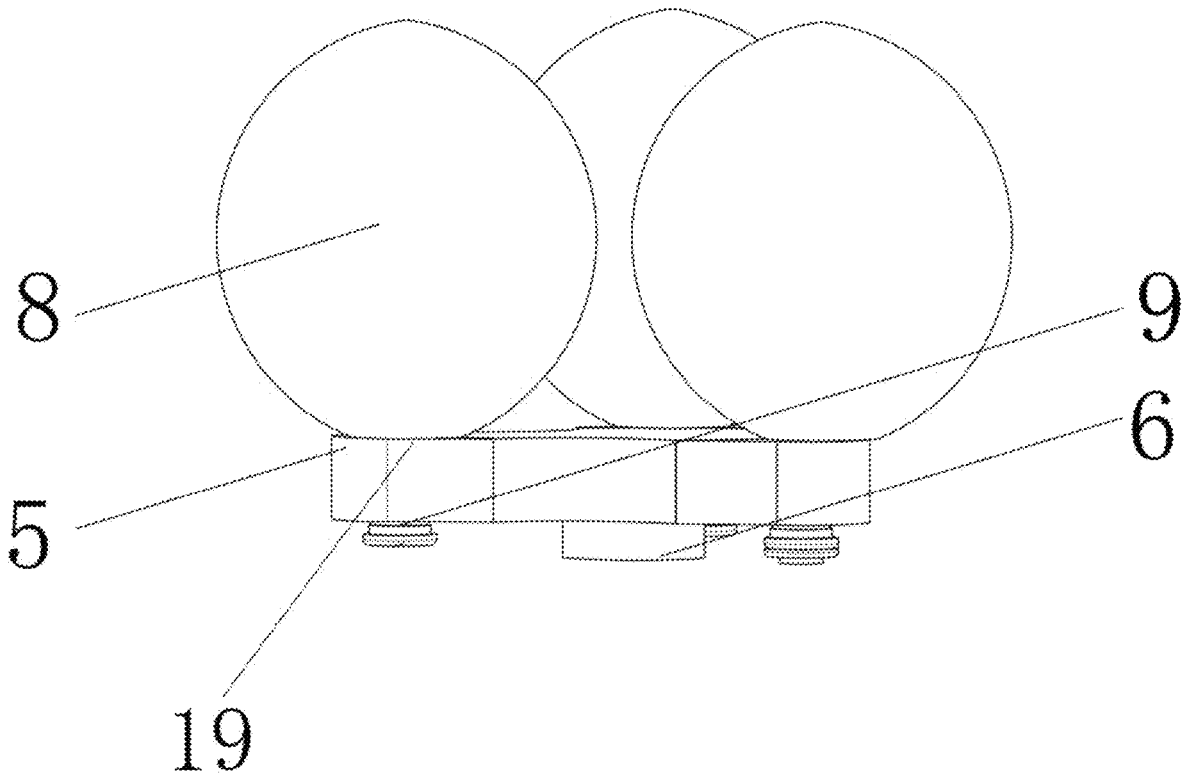
FIG. 3 shows a structural diagram of a turntable in accordance with some embodiments of the present disclosure.

Referring to FIG. 1 to FIG. 3, in some embodiments of the present disclosure, a new type of pressing toy is provided, including a casing 1, with a pressing panel 2 on its front side. The pressing panel 2 is equipped with pressing grooves 14 on its front, and these grooves house pressing components 15, which can be of various shapes such as circular and can pop out for the operator to press them into the pressing grooves 14 using their fingers. The surface of the casing 1 has a charging interface 16, which is a USB interface. A charger can be inserted into the charging interface 16 for charging the toy. Hand grip grooves 17 are provided on both sides of the surface of the casing 1, and these can be equipped with anti-slip components such as anti-slip pads to reduce the likelihood of the casing 1 slipping from the operator's hands. The top surface of the pressing panel 2 is equipped with control buttons 18, including power buttons, sound buttons, and level selection buttons. The casing 1 acts as the outer shell of the pressing toy, with the pressing panel 2 on the front serving as the operational surface of the toy. The spherical objects on the pressing panel 2 can quickly pop out and expose themselves externally based on the different levels. The operator can press these popped-out spherical objects into the pressing panel 2 to clear the level quickly. Additionally, the operator can determine whether pressing is needed based on the brightness of the pressing panel 2. The spherical objects retract into the toy after being pressed, providing good exercise for the user's manual dexterity and observational skills. A turntable 5 is installed on the top surface of the casing 1, with balloons 8 arranged in a circular pattern on the top surface of the turntable 5. The casing 1 contains an air pump 10 that introduces a penalty mechanism. After failing to clear a level, the air pump 10 quantitatively inflates the balloons 8. When the number of failures reaches a certain threshold, the balloons 8 explode, increasing the tension and pressure of the toy, enhancing the excitement of the game experience, making the operator focus on clearing the levels, and adding interest when multiple operators experience it together. This prevents the operator from getting bored with the toy quickly. As an example of gameplay, each balloon 8 can be inflated twice normally. When inflated for the third time, the balloon 8 cannot withstand the pressure and explodes, meaning the operator has two chances to make mistakes. The operator judges based on the brightness of the pressing panel 2 and the popped-out spherical objects, pressing them into the control panel until the level is cleared. If the operator makes a mistake in the same level, the air pump 10 inflates the balloons 8 again, refreshing the level for another attempt. If a mistake occurs again during the second attempt, the air pump 10 continues to inflate the balloons 8. If a third failure occurs when clearing the level, the balloons 8 explode. Whether the level is cleared or not, there is music to indicate success or failure. After a failure, the turntable 5 completes a rotation to alternate the balloons 8. During this alternation, if there is a leak in the inflation end of the balloons 8, they can be reused by reinstallation.

The connection end of the air pump 10 has a threaded connection with an inflation tube 11. The bottom circumference of the turntable 5 has an inflation joint 9, and the position of the inflation joint 9 corresponds to the installation opening on the top surface of the turntable 5. The inflation end of the balloons 8 is embedded in the installation opening on the top surface of the turntable 5, and the inflation end of the balloons 8 is fitted on the surface of the inflation joint 9. When installing the balloons 8 on the turntable 5, the inflation end of the balloons 8 needs to be passed through the installation opening on the turntable 5 first. Then manually pull the inflation end of the balloons 8 outward and flip it up to the surface of the inflation joint 9 on the bottom of the turntable 5. Because the inflation joint 9 has a larger radius, it can expand the inflation end of the balloons 8 outward to limit it. The position of the inflation joint 9 corresponds to the installation opening on the turntable 5, and their numbers are also the same, which can be multiple sets, making it easy for the operator to install multiple balloons 8 together.

Specific Implementation Example 2

Referring to FIG. 1 to FIG. 3, in some embodiments of the present disclosure, a new type of press toy is provided, including a casing 1, herein the front of the casing 1 is provided with a pressing panel 2. The pressing panel 2 has an array of pressing slots 14 on the front side, and the pressing slots 14 are equipped with pressing components 15, which can be of various shapes such as circular and can be popped out for operation personnel to press into the pressing slots 14 using their fingers. The surface of the casing 1 is provided with a charging interface 16, and the charging interface 16 is a USB interface. A charger is inserted into the charging interface 16 to charge the toy. Hand grip slots 17 are opened on both sides of the surface of the casing 1, and the surface of the hand grip slots 17 may be equipped with anti-slip parts such as anti-slip pads to reduce the occurrence of the casing 1 slipping from personnel's hands. The top of the pressing panel 2 is provided with control buttons 18, including power buttons, sound buttons, and level selection buttons. The casing 1 serves as the shell of the press toy, and the front pressing panel 2 of the shell is the pressing operating surface of the toy. The round balls on the pressing panel 2 can quickly pop out and expose themselves to the outside depending on the level, and the player can press the popped-out round balls into the pressing panel 2 to pass the level. Additionally, the player can judge whether to press based on the brightness on the pressing panel 2. After pressing, the round balls retract into the toy, providing good exercise for the user's hand-eye coordination and observation skills.

The top of the casing 1 is equipped with a turntable 5, and the top surface of the turntable 5 is arranged with a circular array of balloons 8. An air pump 10 is installed inside the casing 1, introducing a penalty mechanism. After failing a level, the air pump 10 can quantitatively inflate the balloons 8. When the number of failures reaches a certain limit, the balloons 8 explode, increasing the tense pressure of the toy, enhancing the game's excitement, making the player value the level pass, and increasing the fun when multiple people play together. This design prevents players from getting tired of the toy quickly. For example, each balloon 8 can be inflated twice normally. When inflated for the third time, the balloon 8 explodes, giving the player two chances to make mistakes. The player judges based on the brightness on the pressing panel 2 and the popped-out round balls, pressing them into the control panel until passing the level. If a mistake occurs in the same level, the air pump 10 inflates the balloon 8, refreshing the level. After the second pass with another mistake, the balloon 8 continues to be inflated. On the third failed pass, the balloon 8 explodes. There are sound prompts after passing or failing. After passing with a mistake, the turntable 5 completes a rotation to alternate the balloons 8. During the alternation, if there is air leakage at the inflation end of the balloon 8, it can be reused after fixing it.

The connection end of the air pump 10 is threaded with an inflation tube 11. The bottom of the turntable 5 is threaded with a connecting rod 6. The casing I internally has a lifting member 13, and the lifting end of the lifting member 13 is connected to the bottom of the air pump 10. The lifting member 13 can be a small air cylinder or a lifting structure composed of a motor, a lead screw, and a moving component. It allows the air pump 10 to perform lifting operations inside the casing 1, so that the inflation tube 11 on the air pump 10 can connect or disconnect from the inflation adapter 9 along with the lifting operation.

The bottom of the connecting rod 6 is equipped with an installation head 7. The installation head 7 and the connecting slot interface groove on the top of the connecting head 3 are both cross-shaped, and the installation head 7 and the connecting head 3 mutually magnetically attract each other. After all the balloons 8 on the turntable 5 have exploded, they can be removed and new balloons 8 installed. The installation head 7 on the bottom of the connecting rod 6 is cross-shaped, and it engages with the interface slot on the top of the connecting head 3. The installation head 7 is installed in the interface slot and magnetically attracted to the connecting head 3, allowing the connecting head 3 to drive the connecting rod 6 to rotate together. When it is necessary to remove the turntable 5, it can be lifted upward by hand, making the operation simple.

In the present disclosure, unless otherwise specified and limited, the "above" or "below" of the first feature in relation to the second feature may include direct contact between the first and second features or contact through other features between them. Moreover, the "above," "upwards," and "top" of the first feature in relation to the second feature include the first feature being directly above or diagonally above the second feature or simply indicate that the first feature is at a higher horizontal level than the second feature. The "below," "downwards," and "bottom" of the first feature in relation to the second feature include the first feature being directly below or diagonally below the second feature or simply indicate that the first feature is at a lower horizontal level than the second feature.

The above description illustrates the basic principles, main features, and advantages of the present disclosure. Those skilled in the art should understand that the present disclosure is not limited to the above embodiments. The above embodiments and descriptions are only preferred examples of the present disclosure and are not intended to limit the present disclosure. Within the spirit and scope of the present disclosure, various changes and improvements can be made, and these changes and improvements fall within the scope of protection of the present disclosure as defined by the appended claims.

What is claimed is:

1. A pressing toy with balloon bursting feature, comprising a casing:

wherein a top surface of the casing is provided with balloons, a turntable is installed on the top surface of the casing, and the balloons are arranged in a circular pattern on a top surface of the turntable; wherein a bottom circumference of the turntable is equipped with an inflation joint, an inlet end of each balloon is embedded in an installation port on the top surface of the turntable the inlet end of the balloon is sleeved on a surface of the inflation joint, and the inflation joint corresponds to the installation port penetrating the top surface of the turntable;

wherein a front side of the casing is equipped with a pressing panel, and control buttons are provided on a top surface of the pressing panel; wherein pressing grooves are provided on a front side of the pressing panel and arranged in an array, pressing components are arranged inside the pressing grooves, and the pressing components cooperate with the pressing grooves;

wherein hand grip grooves are provided on both sides of a surface of the casing, the surface of the casing is provided with a charging interface, and the charging interface is a USB interface;

wherein an air pump is provided inside the casing, a connection end of the air pump is threadedly connected with an inflation tube;

wherein a driving motor is further provided inside the casing, and a rotating end of the driving motor is connected to a connecting head, the connecting head is installed inside the casing, and the connecting head is located inside an interface on the top surface of the casing;

wherein a connecting rod is screw-connected to the bottom of the turntable, and an installation joint is provided at a bottom of the connecting rod; and wherein the installation head and a connecting slot on the top of the connecting head are cross-shaped, and the installation head and the connecting head mutually magnetically attract each other.

2. The pressing toy with balloon bursting feature according to claim 1, wherein the inflation tube is embedded in a through hole on the top surface of the casino, a sealing head is provided on a surface of an inlet end of the inflation tube, and the sealing head is in close contact with a bottom surface of the inflation joint.

3. The pressing toy with balloon bursting feature according to claim 1, wherein an elevating member is screw-connected inside the casing, and a lifting end of the elevating member is connected to a bottom surface of the air pump.

* * * * *